United States Patent [19]

Elliott et al.

[11] 4,440,465

[45] Apr. 3, 1984

[54] ELECTRICAL PLUG CONNECTOR LOCK

[76] Inventors: James M. Elliott, 3163 Coolidge Ave., Oakland, Calif. 94602; Eric A. Rickel; Terri F. Rickel, both of 18018 Lazy Dog Rd., Nevada City, Calif. 95959

[21] Appl. No.: 251,325

[22] Filed: Apr. 6, 1981

[51] Int. Cl.[3] ..... H01R 13/62; A44B 13/00

[52] U.S. Cl. ..... 339/75 P; 24/326; 24/578; 24/581

[58] Field of Search ..... 339/75 P; 24/201 HE, 24/201 HH, 225, 226

[56] References Cited

U.S. PATENT DOCUMENTS

| | | | |
|---|---|---|---|
| 3,551,879 | 12/1970 | Waller, Sr. | 339/75 M |
| 4,195,894 | 4/1980 | Kotski | 339/75 R |
| 4,204,738 | 5/1980 | Tillotson | 339/75 R |
| 4,230,389 | 10/1980 | Kotski | 339/75 M |

FOREIGN PATENT DOCUMENTS

| | | | |
|---|---|---|---|
| 334455 | 3/1921 | Fed. Rep. of Germany HE | 24/201 |

*Primary Examiner*—Willie G. Abercrombie

*Attorney, Agent, or Firm*—Harris Zimmerman; Howard Cohen

[57] ABSTRACT

An electrical plug connector lock assembly for retaining the engagement of two plug connectors includes a pair of lock members, each having a collar portion releasably secured to the electrical cable adjacent to the base of the respective plug connector. A pair of arms extends from each collar member toward the other collar member. The arms are provided with means for mutual engagement, so that the engaged plug connectors cannot be longitudinally displaced and disconnected. In one embodiment one of the plug connectors is provided with means for engaging the arms of a confronting locking member.

4 Claims, 9 Drawing Figures

FIG_1
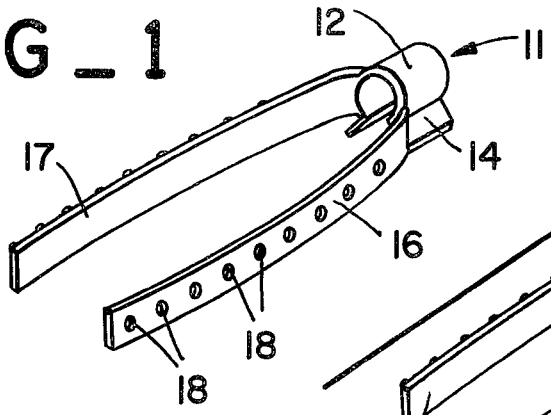
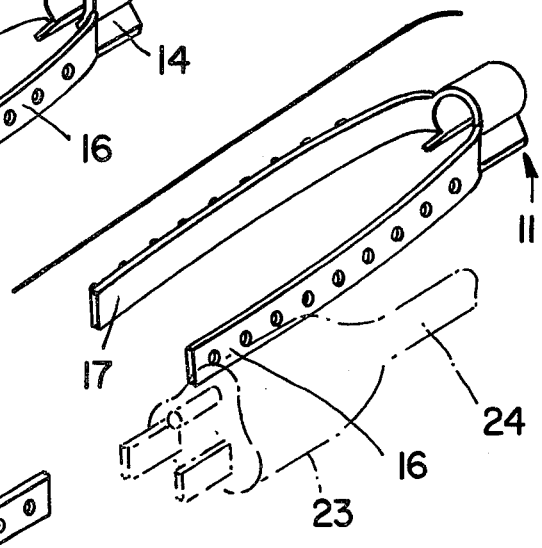
FIG_2
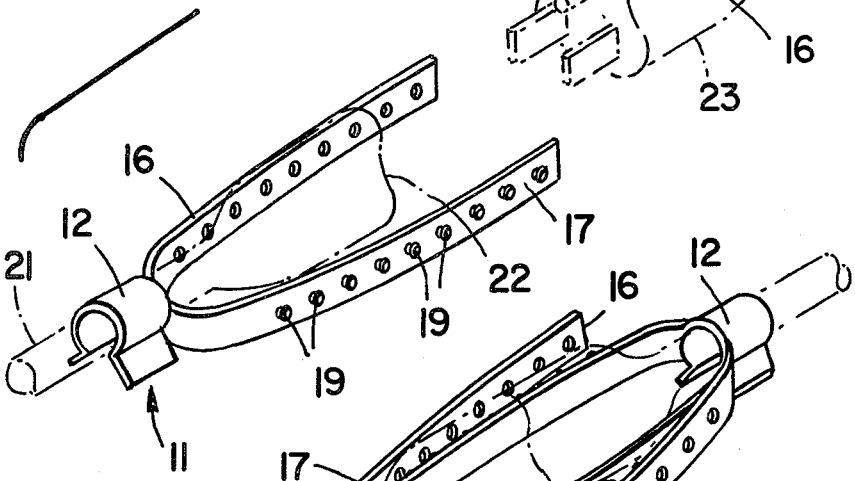
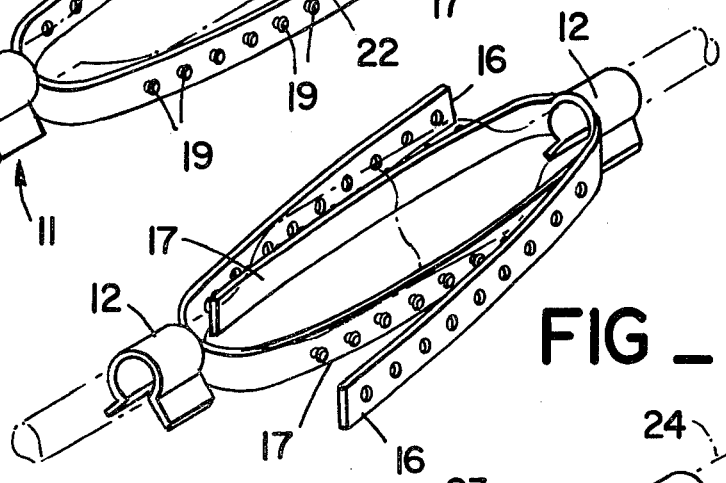
FIG_3
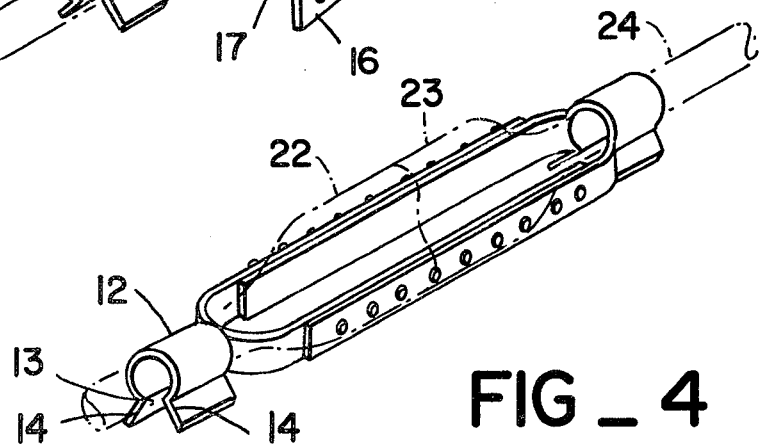
FIG_4

FIG_5
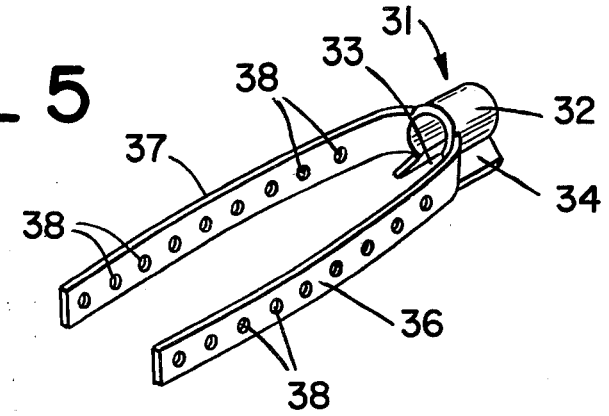
FIG_6
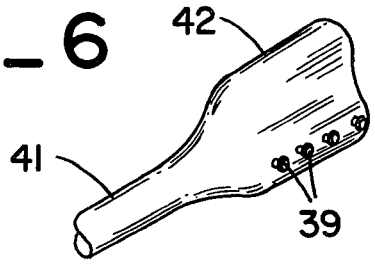
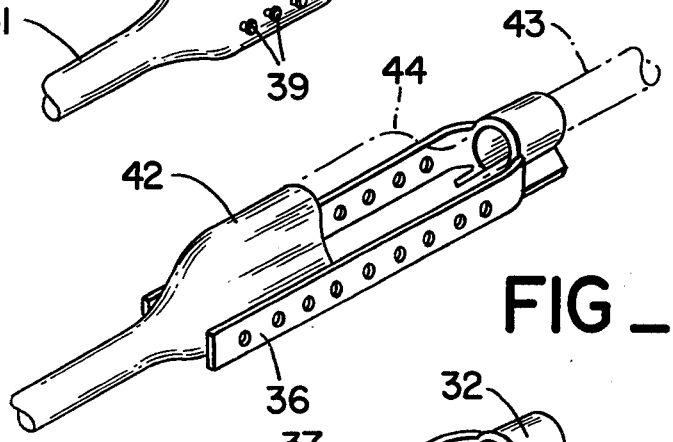
FIG_7
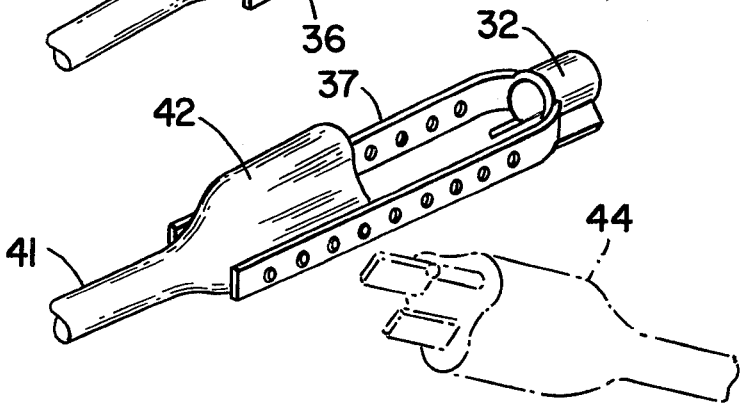
FIG_8
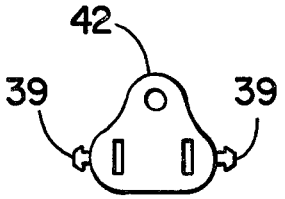
FIG_9

ELECTRICAL PLUG CONNECTOR LOCK

BACKGROUND OF THE INVENTION

In the case of electrical tools and appliances and the like it is common practice to supply power to such devices through an extension cord which is plugged into a power outlet. The plug connector of the power consuming device is matingly engaged with a plug connector at the distal end of the extension cord, as is well known in the prior art.

The engagement of the plug connector of the power consuming device and the extension cord plug connector is generally maintained by the frictional engagement of the cooperating parts of the plug connectors.

It is a common occurrence for the plug connectors in such an arrangement to become spontaneously disconnected, causing great inconvenience and a possible safety hazard. The spontaneous disconnection of these members may be caused by the lack of sufficient frictional engagement therebetween, or by inadvertent tension placed on the extension cord—power cord assembly, or by vibration of the respective parts due to the operation of the power consuming device. When the plug connectors begin to separate spontaneously, the male prongs become exposed before they disconnect from the female conductors in the plug receptacle. As a result, a safety hazard may be created during the spontaneous disconnection of these parts.

SUMMARY OF THE PRESENT INVENTION

The present invention generally comprises a lock assembly which prevents the spontaneous disconnection of electrical plug connectors, while permitting easy disconnection of the plug connectors when desired. In one embodiment of the present invention, a pair of locking members are provided, each locking member including a generally cylindrical collar member having a longitudinal slot extending therein. Each collar member is adapted to be received about and to engage the electrical cable portion immediately adjacent to the base of its respective plug connector. Extending from each collar member toward the other collar member is a pair of flexible arms. The arms of each collar member include means for mutually engaging the arms of the other collar member, so that the pair of locking members may be joined together with a longitudinally fixed, spaced apart relationship. As a result, the plug connectors, once engaged, can not be longitudinally displaced and electrically disconnected without first releasing the engagement of the locking members.

One of each pair of the arms is provided with a plurality of holes spaced longitudinally therealong, while the other of each pair of arms is provided with a plurality of studs extending outwardly from the arm and dimensioned to engage frictionally the holes of the arm of the other locking member. The engagement of the studs and holes provides great tensile strength in the longitudinal direction, and prevents any spontaneous disconnection of the plug connectors. However, very little lateral force is required to overcome the frictional engagement of the holes and studs and release the joined arms. Thus the plug connectors easily may be separated when desired.

In another embodiment of the present invention, one of the plug connectors is provided with a plurality of mounting studs extending from laterally opposed sides of the plug connector. The collar of a locking member is secured about the electrical cable of the other plug connector with the arms thereof engaging the studs extending from the first plug connector. In this embodiment, as in the previous embodiment, the tensile strength of the engagement of the arms of the locking member with the studs of the plug connector prevents spontaneous disconnection of the two plugs, while the purposeful separation of the two plugs is easily accomplished.

A BRIEF DESCRIPTION OF THE DRAWING

FIG. 1 is a perspective view of a locking member of the present invention.

FIG. 2 is an exploded view of a pair of locking members of the present invention disposed for mutual engagement.

FIG. 3 is a perspective view of a pair of locking members of the present invention assembled to a pair of engaged plug connectors.

FIG. 4 is a perspective view of the present invention, shown in the locked disposition in conjunction with a pair of engaged plug connectors.

FIG. 5 is a perspective view of a further embodiment of the locking member of the present invention.

FIG. 6 is a perspective view of a plug connector adapted for assembly to the locking member of the further embodiment of FIG. 5.

FIG. 7 is a perspective view showing the assembly of the embodiments of FIGS. 5 and 6 in the locked disposition.

FIG. 8 is a perspective view showing the assembly of FIG. 7 in the disconnected disposition.

FIG. 9 is a plan view of the portion of the further embodiment shown in FIG. 6.

DESCRIPTION OF THE PREFERRED EMBODIMENT

With reference to FIGS. 1–4, one embodiment of the present invention comprises an electrical plug connector locking assembly which is adapted to secure and retain the engagement of two electrical plug connectors. The locking assembly of the present invention is comprised of a pair of locking members 11, each of which is provided with a generally cylindrical collar 12. The collar 12 has formed therein a longitudinally extending slot 13, with flanges 14 extending obliquely outwardly from the opposed edges of the slot 13. The collar is fabricated of a form retaining yet resilient substance, so that the collar may be snappingly engaged to an electrical cable by introducing the cable into the collar through the slot 13. The collar 12 is advantangeously secured to an electrical cable 21 directly adjacent to its junction with the base of an electrical plug connector 22.

Extending longitudinally from one end of the collar 12 is a pair of arms 16 and 17 which are disposed in laterally opposed fashion. The arm 16 is provided with a plurality of holes 18 spaced longitudinally therealong. The arm 17 is provided with a plurality of studs 19 spaced longitudinally therealong and extending laterally outwardly therefrom. The arms 16 and 17 may likewise be formed of a resilient, form retaining substance. Indeed, the entire member 11 may be formed integrally of metal or plastic by production techniques well known in the prior art.

As mentioned in the foregoing, the locking assembly of the present invention is comprised of a pair of locking members 11. As shown in FIG. 2, one of the locking members 11 is joined to a cable 21 adjacent to a female plug connector 22 by urging the cable 21 through the slot 13 to be retained within the collar. It may be appreciated that the arms 16 and 17 extend longitudinally forwardly adjacent to and beyond the plug connector 22. Another locking member 11 is joined to an electrical cable 24 directly adjacent to its conjunction with the base of a male electrical plug connector 23. After the assembly of the locking members 11 to their respective cables 21 and 24, the electrical plug connectors 22 and 23 are joined for electrical connection, as is known in the prior art. This step causes the arms 16 and 17 of the locking members 11 to become disposed in adjacent, overlapping confrontation, as shown in FIG. 3. The overlapping portions are sufficiently long so that plug connectors of differing lengths may be accommodated.

It may be appreciated that the holes 18 arrayed in each arm 16 are adapted to engage frictionally the studs 19 which extend outwardly from each of the arms 17. The arms 16 and 17 may be urged together manually to cause the studs 19 to become engaged in the holes 18 of the overlapping portions. When this engagement has been effected, the two locking members 11 are joined so that they cannot be displaced in the longitudinal direction. As a result, as shown in FIG. 4, the two plug connectors 22 and 23 likewise cannot be displaced longitudinally and the electrical connection therebetween cannot be broken. Thus, spontaneous interruption of the power circuit formed by the two plug connectors is effectively eliminated.

However, it is quite easy purposely to separate the plug connectors to interrupt the power connection therebetween. This action may be effected by removing one of the collars 12 from its respective electrical cable. The resilient arms 16 and 17 permit the free collar to be lifted clear of its respective cable and plug connector, so that the two plug connectors may be longitudinally separated. Likewise, the locking assembly may be disengaged by first disengaging the joined arms 16 and 17 of the pair of locking members 11, thus returning them to the state shown in FIG. 3.

With reference to FIGS. 5–9, a further embodiment of the present invention includes a locking member 31 which is adapted to engage directly a plug connector 42 which is constructed according to the present invention. The locking member 31 includes a generally cylindrical collar 32 having a slot 33 extending longitudinally therein. As in the previous embodiment, a pair of flanges 34 extend obliquely outwardly from the opposed edges of the slot 33, which is provided to permit an electrical cable to be snappingly engaged within the collar 32.

A pair of resilient arms 36 and 37 extend longitudinally from one end of the collar 32, and are disposed in laterally opposed fashion. Each of the arms 36 and 37 is provided with a plurality of holes 38 extending therethrough and spaced longitudinally therealong. As in the previous embodiment, the locking member 31 may be formed integrally of plastic or metal by production techniques known in the prior art.

The present embodiment also includes an electrical plug connector 42 which is joined to one end of an electrical cable 41. In the accompanying figures, the plug 42 is depicted as a female connector having two electrical and one ground receptacle, although it may be appreciated that many other forms and configurations of plug connectors may be constructed according to this embodiment. The salient feature of the plug connector 42 is a provision of a plurality of studs 39 protruding outwardly from and spaced longitudinally along opposed sides of the plug connector. The studs 39 are dimensioned to be frictionally engaged and retained by the holes 38 of the arms 36 and 37.

With reference to FIG. 7, the collar 32 of the locking member 31 may be snappingly secured about an electrical cable 43 adjacent to its junction with a standard electrical plug connector 44. The arms 36 and 37 extend longitudinally forwardly from the collar 32. After the two electrical plug connectors 42 and 44 are joined in electrically conducting fashion, the arms 36 and 37 are disposed to extend adjacent to the studs 39 extending from the laterally opposed sides of the plug connector 42. The arms 36 and 37 are then urged manually toward the connector 42 to engage the studs 39 within the holes 38. This engagement renders the locking member 31 fixedly secured to the connector 42 in the longitudinal direction, and prevents displacement of the two connectors in the longitudinal direction. As a result, spontaneous disconnection of the two connectors is eliminated.

As shown in FIG. 8, the locked connector assembly of FIG. 7 easily may be disconnected by first snappingly disengaging the collar 32 from the cable 43. The collar then may be moved clear of the connector 44, due to the resiliency of the arms 36 and 37, so that the two connector members may be longitudinally separated and disconected. Likewise, the assembly of FIG. 7 may be separated by first disengaging the arms 36 from the studs 39, so that the plug connectors may be disconnected.

It should be noted that either embodiment of the present invention can be advantageously employed with a wide variety of electrical plug connector configurations and conductor arrangements.

We claim:

1. A locking assembly for retaining together a pair of mutually engaging plug connectors extending from separate cable members, comprising; a pair of substantially identical locking members, each locking member including a collar portion adapted to engage one of said cable portions adjacent to the base of the respective plug connector, each collar portion including means for releasably engaging said cable portion, said means comprising a tubular member having a bore extending therethrough and dimensioned to receive said cable portion therein, and a slot extending longitudinally through said tubular member, said slot being narrower than the diameter of said cable portion and adapted to admit or release said cable portion in resiliently engaging fashion; a pair of arms extending longitudinally from each of said collar members toward the other collar member; and means on each of said pair of arms for mutual engagement with the arms of the other locking member to join said locking members in fixed longitudinal relationship.

2. The locking assembly of claim 1, wherein said means for mutual engagement include a plurality of holes spaced longitudinally along one of each pair of arms, and a plurality of studs spaced longitudinally along the other of each pair of arms, said holes and said studs being adapted for mutual engagement and retention.

3. The locking assembly of claim 1, further including a pair of flange members extending obliquely outwardly from opposed edges of said slot.

4. The locking assembly of claim 1, wherein said collar portion and said pair of arms are formed integrally of a form-retaining, resilient substance.

* * * * *